US008750756B2

(12) United States Patent
Tanda

(10) Patent No.: US 8,750,756 B2
(45) Date of Patent: Jun. 10, 2014

(54) IMAGE FORMING APPARATUS FOR PERFORMING FIXING PROCESSING BY INDUCTION HEATING SYSTEM

(75) Inventor: Tetsuo Tanda, Osaka (JP)

(73) Assignee: Kyocera Mita Corporation (JP)

( * ) Notice: Subject to any disclaimer, the term of this patent is extended or adjusted under 35 U.S.C. 154(b) by 156 days.

(21) Appl. No.: 13/425,786

(22) Filed: Mar. 21, 2012

(65) Prior Publication Data

US 2012/0251157 A1 Oct. 4, 2012

(30) Foreign Application Priority Data

Mar. 30, 2011 (JP) ..... 2011-075656

(51) Int. Cl.
*G03G 15/16* (2006.01)

(52) U.S. Cl.
USPC ..... 399/122; 399/68; 399/94; 399/328; 399/329

(58) Field of Classification Search
USPC ..... 399/68, 122, 320, 328, 329
See application file for complete search history.

(56) References Cited

U.S. PATENT DOCUMENTS 6,725,009 B1 * 4/2004 Tatematsu et al. ..... 399/329
6,865,364 B2 * 3/2005 Matsumoto ..... 399/329
7,720,415 B2 * 5/2010 Murano ..... 399/126
2006/0002737 A1 * 1/2006 Shinshi ..... 399/122
2006/0285893 A1 12/2006 Ishii
2009/0263155 A1 10/2009 Murano
2011/0135341 A1 * 6/2011 Kamiya et al. ..... 399/122

FOREIGN PATENT DOCUMENTS

JP 2006-350054 12/2006
JP 2009-258457 11/2009

* cited by examiner

*Primary Examiner* — David Gray
*Assistant Examiner* — Francis Gray
(74) *Attorney, Agent, or Firm* — Gerald E. Hespos; Michael J. Porco; Matthew T. Hespos

(57) ABSTRACT

An image forming apparatus includes a first housing, a second housing on which the first housing is mounted, a first roller, a second roller, a nipping pressure adjusting mechanism, an induction heating unit and a retaining mechanism. A first rotary shaft of the first roller is rotatably supported by the first housing in a state of being positionally immovable. A second rotary shaft of the second roller is rotatably supported by the first housing in a state of being positionally movable. The nipping pressure adjusting mechanism changes the posture of the second roller between a first posture that the second roller is pressingly contacted with the first roller with a first pressure, and a second posture that the second roller is pressingly contacted with the first roller with a second pressure lower than the first pressure. The relative positions between the second roller and the induction heating unit are retained.

7 Claims, 9 Drawing Sheets

IMAGE FORMING APPARATUS FOR PERFORMING FIXING PROCESSING BY INDUCTION HEATING SYSTEM

This application is based on Japanese Patent Application No. 2011-075656 filed on Mar. 30, 2011, the contents of which are hereby incorporated by reference.

BACKGROUND

The present disclosure relates to an image forming apparatus for performing a fixing processing onto a sheet carrying a transferred image by an induction heating (IH) system.

A fixing device in an image forming apparatus is provided with a fixing roller and a pressing roller. A sheet carrying a transferred toner image is allowed to pass a fixing nip portion formed by the fixing roller and the pressing roller. After having passed the fixing nip portion, the sheet undergoes heating and pressurization to thereby fix the toner image onto the sheet. As such a fixing device, there is known an IH fixing device employing an induction heating system as a system for generating heat to apply the heat to a sheet. The IH fixing device includes an IH unit provided with an induction heating coil for generating magnetic flux and a core member for forming a magnetic path, and a fixing unit having a heating roller (or a heating belt) to be inductively heated by the IH unit.

The fixing unit is required to be exchanged resulting from e.g. aging deterioration. In this case, it is uneconomical to exchange the entirety of the IH fixing device regardless that the IH unit is not deteriorated. The IH unit and the fixing unit are configured individually. Specifically, the IH unit is mounted on a main body of the image forming apparatus, and the fixing unit is detachably mounted on the apparatus body. In the case where these units are configured individually, it may be difficult to keep the distance between an induction heating coil and a heating roller unchanged before the fixing unit is dismounted and after the fixing unit is mounted. If the distance between the induction heating coil and the heating roller varies, the induction heating effect also varies, which makes it impossible or difficult to accurately generate an intended fixation heat in the heating roller. In view of this, in the IH fixing device of the above type, there is provided a positioning mechanism capable of keeping the distance between the induction heating coil and the heating roller unchanged.

There is known a fixing unit provided with a nipping pressure adjusting mechanism configured in such a manner that a nipping pressure in the fixing nip portion is switched between a normal pressurized (high-pressure) state and a depressurized (low-pressure) state. The nipping pressure adjusting mechanism is operable to set the nipping pressure to the normal pressurized state, in the case where a sheet having an ordinary thickness is allowed to pass the fixing nip portion, and is operable to set the nipping pressure to the depressurized state, in the case where thick paper such as an envelope or thin paper is allowed to pass the fixing nip portion, or a jammed sheet is to be removed. A rotary shaft of the pressing roller is supported in the housing of the fixing unit in such a manner that the pressing roller is selectively moved (shifted) in a direction toward or away from the fixing roller, and the nipping pressure adjusting mechanism is operable to switch the nipping pressure state, using a driving force of a motor. The switching of the nipping pressure enables to suppress generation of a crease and the like in passing thick paper or thin paper through the fixing nip portion, or allows the user to easily remove a jammed sheet.

In the conventional apparatus, a pressing roller is used as a roller to be positionally moved in order to easily keep the positional relationship between a fixing roller (a heating roller) and an induction heating coil unchanged. Specifically, if the fixing roller is kept unmoved, the position of the fixing unit relative to the induction heating coil is determined at the point of time when the fixing unit is mounted at a predetermined position of the main body of the image forming apparatus. Thus, there is no likelihood that the position of the fixing unit may be displaced when the fixing nip portion is formed.

Further, in the conventional apparatus, transmission of a rotational driving force from driving means of the apparatus body to each of the rollers in the fixing unit is realized by inputting a driving force to the rotary shaft of the pressing roller. This is because whereas the fixing roller is a sponge-like roller, the pressing roller is a roller having rigidity higher than the rigidity of the fixing roller. In the case where a fixing roller whose outer diameter is likely to vary is used as a roller to which a driving force is inputted, the circumferential speed of the outer circumference of the roller may vary, which makes it impossible or difficult to accurately control the rotation of the roller.

However, as described above, the pressing roller is a roller whose rotary shaft is positionally moved, it is necessary to modify the mechanism for inputting a driving force to the pressing roller. In other words, the above arrangement complicates the mechanism for inputting a driving force to the pressing roller whose axis of rotation is positionally moved, as the nipping pressure state is switched between the normal pressurized state and the depressurized state, and may result in a cost increase.

It is an object of the present disclosure to provide an image forming apparatus of an IH fixing system provided with an IH fixing unit detachably mounted on the apparatus body, which enables to simplify a mechanism for inputting a rotational driving force to the fixing unit.

SUMMARY

An image forming apparatus equipped with an IH fixing device according to an aspect of the disclosure includes a first housing, a second housing, a first roller, a second roller, a nipping pressure adjusting mechanism, an induction heating unit, a retaining mechanism and a driving mechanism.

The first housing accommodates a member for performing a fixing processing. The second housing accommodates an image forming section for forming an image onto a sheet, with the first housing being mounted thereon. The first roller has a first rotary shaft, and is rotatably supported by the first housing in a state that the first rotary shaft is kept unmoved. The second roller has a second rotary shaft, is rotatably supported by the first housing in a state that the second rotary shaft is movable, and forms a fixing nip portion, with the first roller, in which the fixing processing is applied to the sheet. The nipping pressure adjusting mechanism changes the posture of the second roller between a first posture that the second roller is pressingly contacted with the first roller with a first pressure, and a second posture that the second roller is pressingly contacted with the first roller with a second pressure lower than the first pressure by shifting the second rotary shaft from the first posture. The induction heating unit is mounted on the second housing for generating magnetic flux for generating heat necessary for performing the fixing processing. The retaining mechanism retains the relative positions between the second roller and the induction heating unit both in the case where the second roller is in the first posture and in the second posture. The driving mechanism gives a rotational driving force to the first roller.

These and other objects, features and advantages of the present disclosure will become more apparent upon reading the following detailed description along with the accompanying drawings.

DETAILED DESCRIPTION

Figure 1:
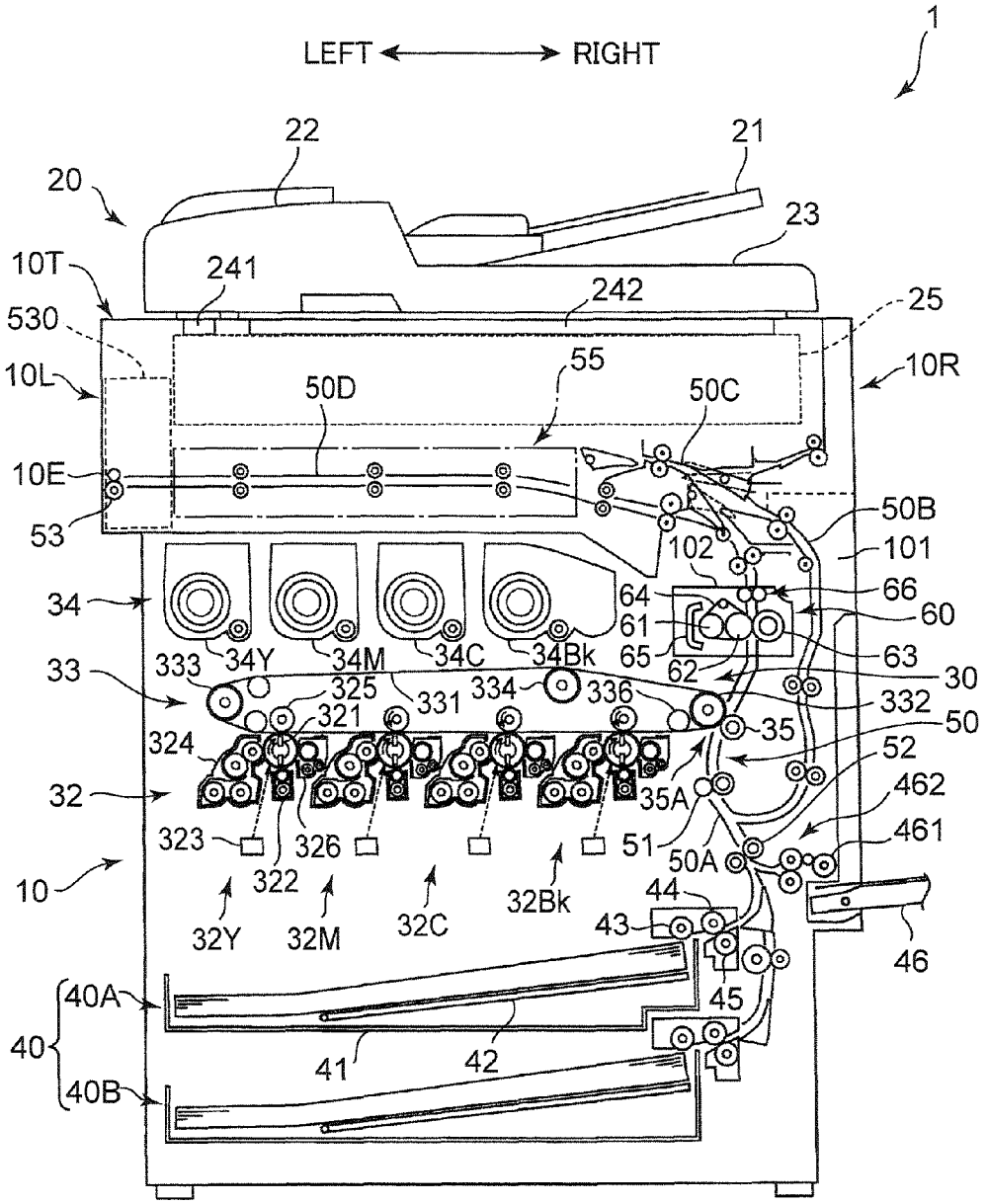
FIG. 1 is a cross-sectional view showing an internal structure of an image forming apparatus embodying the present disclosure.

In the following, an embodiment of the present disclosure is described referring to the drawings. FIG. 1 is a cross-sectional view showing an internal structure of an image forming apparatus 1 (an image forming apparatus equipped with an IH fixing device) embodying the present disclosure. In this embodiment, the image forming apparatus 1 is a copying machine. Alternatively, the image forming apparatus 1 may be a printer, a facsimile device, or a complex machine provided with the functions of these devices, as far as the image forming apparatus 1 employs an IH fixing system.

The image forming apparatus 1 is provided with an apparatus body 10 (a second housing) having a generally rectangular parallelepiped casing structure, and an automatic document feeder 20 to be disposed on the apparatus body 10. The apparatus body 10 is internally provided with a reading unit 25 for optically reading a document image to be copied, an image forming section 30 for forming a toner image onto a sheet, a fixing device 60 for fixing the toner image onto the sheet, a sheet feeding section 40 for storing sheets to be conveyed to the image forming section 30, a conveyance path 50 for conveying the sheets one by one from the sheet feeding section 40 to a sheet discharge port 10E via the image forming section 30 and the fixing device 60, and a conveyance unit 55 internally formed with a sheet conveyance path constituting a part of the conveyance path 50.

A right side surface 10R of the apparatus body 10 is formed with a main body cover 101 which is opened and closed in dismounting a unit such as the image forming section 30 and the fixing device 60 from the apparatus body 10 for removing a jammed sheet or for maintenance service. The main body cover 101 is mounted on the apparatus body 10 to be pivotally movable about a base end of the main body cover 101 (a lower end of the main body cover 101) (also see FIG. 2).

The automatic document feeder 20 is pivotally mounted on a top surface of the apparatus body 10. The automatic document feeder 20 automatically feeds a document sheet to be copied toward a predetermined document reading position (a mounted position of a first contact glass 241) of the apparatus body 10. When the user manually places a document sheet or sheets onto a predetermined document reading position (a disposed position of a second contact glass 242), the automatic document feeder 20 is opened upward. The automatic document feeder 20 includes a document tray 21 on which a document sheet or sheets are placed, a document transport section 22 for transporting the document sheet(s) via the automatic document reading position, and a document discharge tray 23 on which the document sheet(s) after image reading are discharged.

The reading unit 25 optically reads an image of a document sheet through the first contact glass 241 for reading the image of the document sheet to be automatically fed from the automatic document feeder 20 disposed on the top surface of the apparatus body 10, or through the second contact glass 242 for reading the image of the document sheet to be placed manually by the user. The reading unit 25 accommodates therein a scanning mechanism including a light source, moving carriages, and reflection mirrors; and an image sensor, all of which are not shown. The scanning mechanism irradiates light onto a document sheet, and guides the light reflected from the document sheet to the image sensor. The image sensor photoelectrically converts the reflected light into an analog electric signal. The analog electric signal is converted into a digital electric signal by an A/D conversion circuit, and then, the digital electric signal is inputted to the image forming section 30.

The image forming section 30 is adapted to perform a processing of generating a full-color toner image and transferring the toner image onto a sheet, and includes an image forming unit 32 having tandemly-arranged four units 32Y, 32M, 32C, and 32Bk for respectively forming toner images of yellow (Y), magenta (M), cyan (C) and black (Bk), an intermediate transfer unit 33 disposed adjacent to and above the image forming unit 32, and a toner replenishing section 34 disposed above the intermediate transfer unit 33.

Each of the image forming units 32Y, 32M, 32C, and 32Bk includes a photosensitive drum 321; and a charger 322, an exposure device 323, a developing device 324, a primary transfer roller 325 and a cleaning device 326, which are disposed in the periphery of the photosensitive drum 321.

The photosensitive drum 321 rotates about the axis thereof, and an electrostatic latent image and a toner image are formed on the circumferential surface thereof. An example of the photosensitive drum 321 is a photosensitive drum using an amorphous silicon (a-Si)-based material. The charger 322 uniformly charges the surface of the photosensitive drum 321. The exposure device 323 has a laser light source and an optical device such as mirrors and lenses, and forms an electrostatic latent image on the circumferential surface of the photosensitive drum 321 by irradiating light derived from image data of a document image.

The developing device 324 supplies toner to the circumferential surface of the photosensitive drum 321 for developing an electrostatic latent image formed on the photosensitive drum 321. The developing device 324 is adapted for a two-component developer, and includes agitation rollers, a magnetic roller, and a developing roller. The agitation rollers circulate and transport the two-component developer while agitating the two-component developer to thereby charge the toner. A two-component developer layer is borne on the circumferential surface of the magnetic roller, and a toner layer formed by transferring the toner by an electric potential difference between the magnetic roller and the developing roller is borne on the circumferential surface of the developing roller. The toner on the developing roller is supplied to the circumferential surface of the photosensitive drum 321, whereby the electrostatic latent image is developed.

The primary transfer roller 325 forms a nip portion with the photosensitive drum 321, with an intermediate transfer belt 331 provided in the intermediate transfer unit 33 being interposed, for primarily transferring a toner image on the photosensitive drum 321 onto the intermediate transfer belt 331. The cleaning device 326 has a cleaning roller, and cleans the circumferential surface of the photosensitive drum 321 after toner image transfer.

The intermediate transfer unit 33 is provided with the intermediate transfer belt 331, a drive roller 332, a driven roller 333, a tension roller 334 and a backup roller 336. The intermediate transfer belt 331 is an endless belt which is wound around the rollers 332, 333, 334, 336 and the primary transfer rollers 325; and toner images are transferred one over the other at a certain position on the outer circumferential surface of the intermediate transfer belt 331 from the plurality of photosensitive drums 321 (primary transfer).

The drive roller 332 is a roller formed by molding a sponge-like electrically conductive rubber into a cylindrical shape on an electrically conductive shaft made of a metal, and a driving force for circulating the intermediate transfer belt 331 is given to the drive roller 332. A secondary transfer roller 35 is disposed at a position opposing the circumferential surface of the drive roller 332. The secondary transfer roller 35 is also an electrically conductive roller. A nip portion between the drive roller 332 and the secondary transfer roller 35 serves as a secondary transfer section 35A for transferring a full-color toner image obtained by laying the color toner images one over the other on the intermediate transfer belt 331 onto a sheet.

A secondary transfer bias potential having a polarity opposite to the polarity of the toner image is applied to the secondary transfer roller 35, and the drive roller 332 is grounded. The driven roller 333 is a roller that is driven in accordance with the circulation of the intermediate transfer belt 331, the tension roller 334 is a roller for giving a predetermined tension force to the intermediate transfer belt 331, and the backup roller 336 is a roller for bending the intermediate transfer belt 331 at a position immediately upstream of the secondary transfer section 35A in the circulating direction of the intermediate transfer belt 331.

The toner replenishing section 34 includes a yellow toner container 34Y, a magenta toner container 34M, a cyan toner container 34C, and a black toner container 34Bk. These toner containers 34Y, 34C, 34M, 34Bk respectively store toners of the corresponding colors, and supply the toners of the corresponding colors to the developing devices 324 of the image forming units 32Y, 32M, 32C, 32Bk respectively corresponding to the colors of YMCBk through an unillustrated supply route.

The sheet feeding section 40 is provided with two sheet cassettes 40A, 40B which are stacked one over the other for storing sheets for image formation thereon, and a sheet feeding tray 46 for manual feeding. The sheet cassettes 40A, 40B are withdrawable in a forward direction from the front side of the apparatus body 10. The sheet cassettes 40A, 40B are cassettes designed for automatic sheet feeding, and the sheet feeding tray 46 for manual feeding is provided on the right side surface 10R of the apparatus body 10. The sheet feeding tray 46 is mounted on the main body cover 101 to be openable and closable at a lower end of the sheet feeding tray 46. When a sheet or sheets are manually fed, the user opens the sheet feeding tray 46 as illustrated in FIG. 1, and places the sheet(s) on the sheet feeding tray 46.

The sheet cassette 40A (40B) is provided with a sheet storage section 41 for storing a sheet stack constituted of a stack of sheets, and a lifting plate 42 for lifting the sheet stack for sheet feeding. A pickup roller 43, and a pair of rollers constituted of a sheet feeding roller 44 and a retard roller 45 are disposed at an upper position on the right end side of the sheet cassette 40A (40B). By driving the pickup roller 43 and the sheet feeding roller 44, the sheets of the sheet stack in the sheet cassette 40A are sent out one by one from an uppermost sheet thereof, and are conveyed to the upstream end of the conveyance path 50. On the other hand, the sheets placed on the sheet feeding tray 46 are conveyed into the conveyance path 50 by driving a pickup roller 461 and a sheet feeding roller 462.

The conveyance path 50 includes a main conveyance path 50A for conveying a sheet from the sheet feeding section 40 to the exit of the fixing device 60 via the image forming section 30; a reverse conveyance path 50B for returning a sheet after a one-side printing to the image forming section 30 for performing a double-sided printing for the sheet; a switch-back conveyance path 50C for directing a sheet from the downstream end of the main conveyance path 50A to the upstream end of the reverse conveyance path 50B; and a horizontal conveyance path 50D for horizontally conveying a sheet from the downstream end of the main conveyance path 50A to the sheet discharge port 10E formed in a left side surface 10L of the apparatus body 10. A main part of the horizontal conveyance path 50D is constituted of a sheet conveyance path formed in the conveyance unit 55.

A registration roller pair 51 is disposed upstream of the main conveyance path 50A with respect to the secondary transfer section 35A. A sheet conveyed through the main conveyance path 50A is contacted with the registration roller pair 51 in a suspended state, and the conveyance of the sheet is temporarily stopped thereat for skew correction. Thereafter, the sheet is fed to the secondary transfer section 35A at a predetermined timing for image transfer by driving the registration roller pair 51 by a drive motor (not shown). A plurality of pairs of conveyance rollers 52 for conveying a sheet are disposed in the main conveyance path 50A, in addition to the abovementioned rollers. The same arrangement as described above is applied to the conveyance paths 50B, 50C, 50D.

A sheet discharge unit 530 provided with a sheet discharge roller pair 53 is disposed at a most downstream end of the conveyance path 50 at a position on the left side of the conveyance unit 55 and adjacent thereto in FIG. 1. The sheet discharge roller pair 53 feeds a sheet to an unillustrated post-processing device which is connected to the apparatus body 10 and is disposed on the left side surface 10L side of the apparatus body 10 through the sheet discharge port 10E. In the case where a post-processing device is not mounted on the image forming apparatus, a sheet discharge tray is disposed at a position below the sheet discharge port 10E.

The conveyance unit 55 is a unit for conveying a sheet outputted from the fixing device 60 to the sheet discharge port 10E. The image forming apparatus 1 of the embodiment is configured in such a manner that the fixing device 60 is disposed on the right side surface 10R side of the apparatus body 10, and the sheet discharge port 10E is disposed on the left side surface 10L side of the apparatus body 10 facing the right side surface 10R. With this arrangement, the conveyance unit 55 horizontally conveys a sheet from the right side surface 10R of the apparatus body 10 toward the left side surface 10L of the apparatus body 10.

The fixing device 60 is a fixing device employing an induction heating system for performing a fixing processing of fixing a toner image onto a sheet, and includes a heating roller 61 (a third roller), a fixing roller 62 (a second roller), a pressing roller 63 (a first roller), a fixing belt 64 (a belt member), an induction heating unit 65 and a conveyance roller pair 66. The fixing device 60 is disposed in an accommodation space 102 formed near the right side surface 10R of the apparatus body 10.

Figure 2:
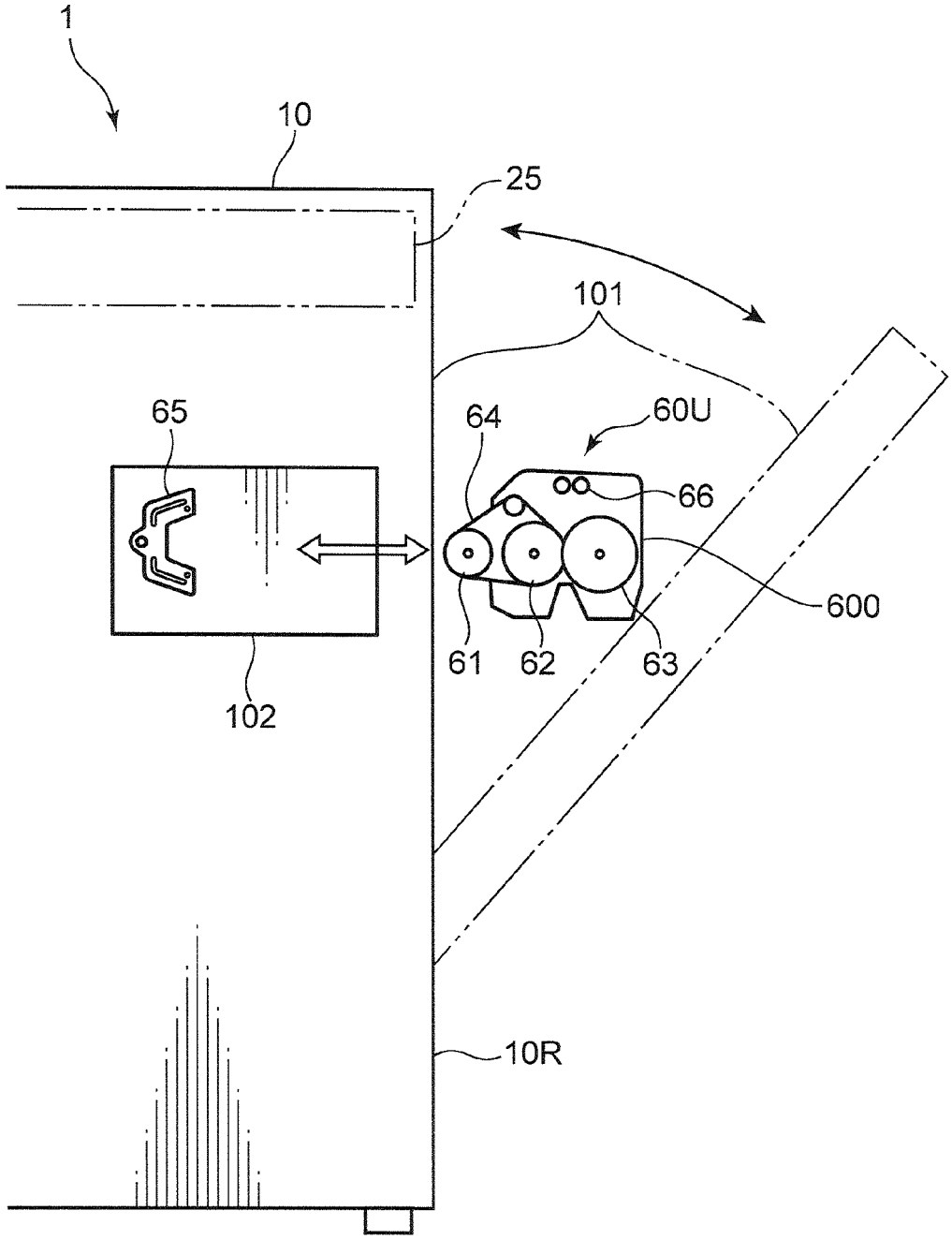
FIG. 2 is a simplified diagram showing a state that a fixing unit (a first housing) is dismounted from an apparatus body (a second housing).

As shown in FIG. 2, the aforementioned elements other than the induction heating unit 65 are accommodated in a housing 600 (a first housing), and are configured into a fixing unit 60U. The fixing unit 60U is detachably mounted on the apparatus body 10. On the other hand, the induction heating unit 65 is mounted at an appropriate position in the accommodation space 102 of the apparatus body 100, and only the induction heating unit 65 remains in the accommodation space 102 in a state that the fixing unit 60U is dismounted from the apparatus body 10. With this arrangement, in the case where the fixing unit 60U is required to be exchanged resulting from e.g. aging deterioration, regardless that the induction heating unit 65 is not deteriorated, it is possible to exchange only the fixing unit 60U, while retaining the induction heating unit 65 in the apparatus body 10.

Figure 3:
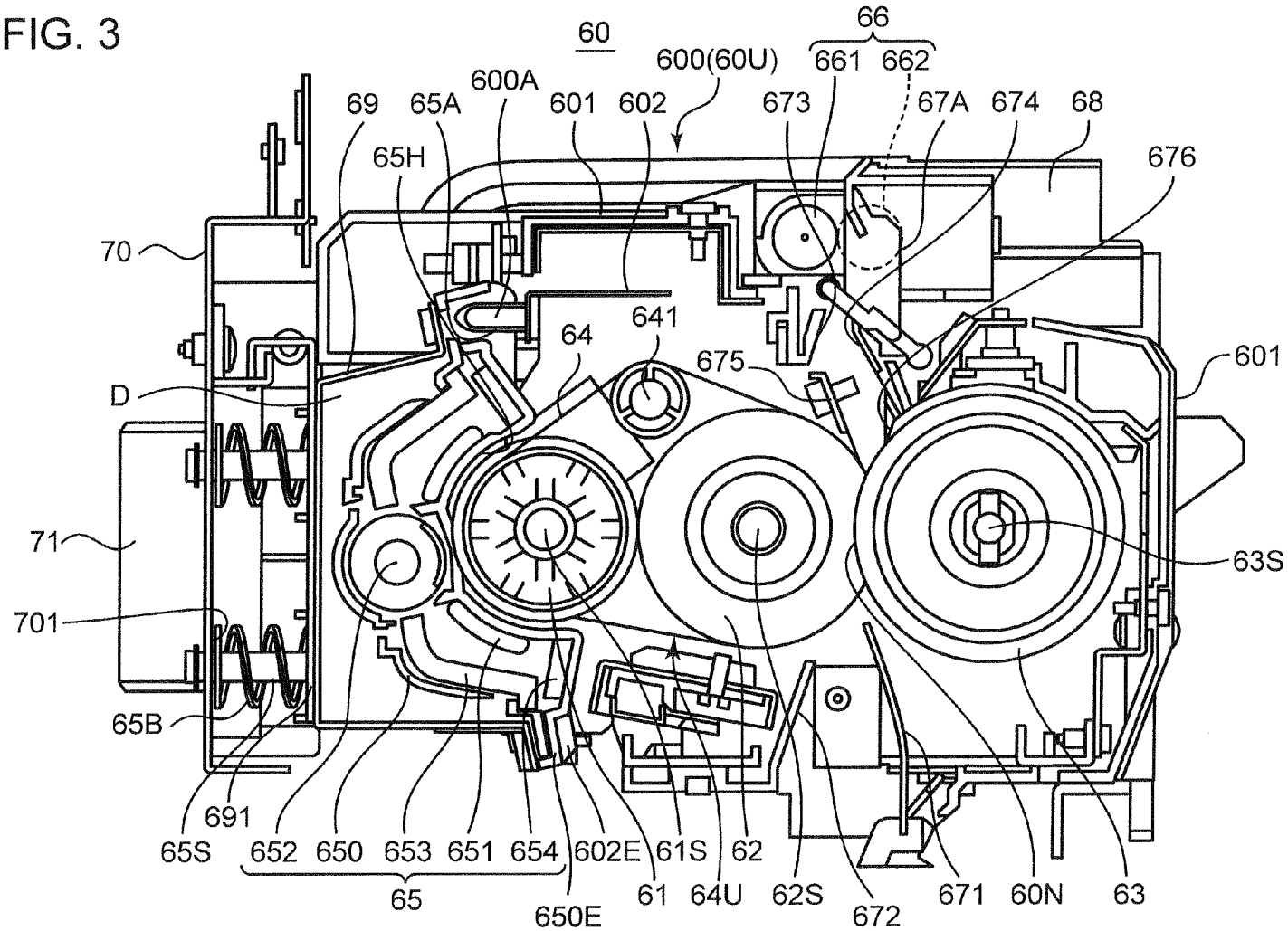
FIG. 3 is a cross-sectional view showing an internal structure of a fixing device embodying the present disclosure.
Figure 4:
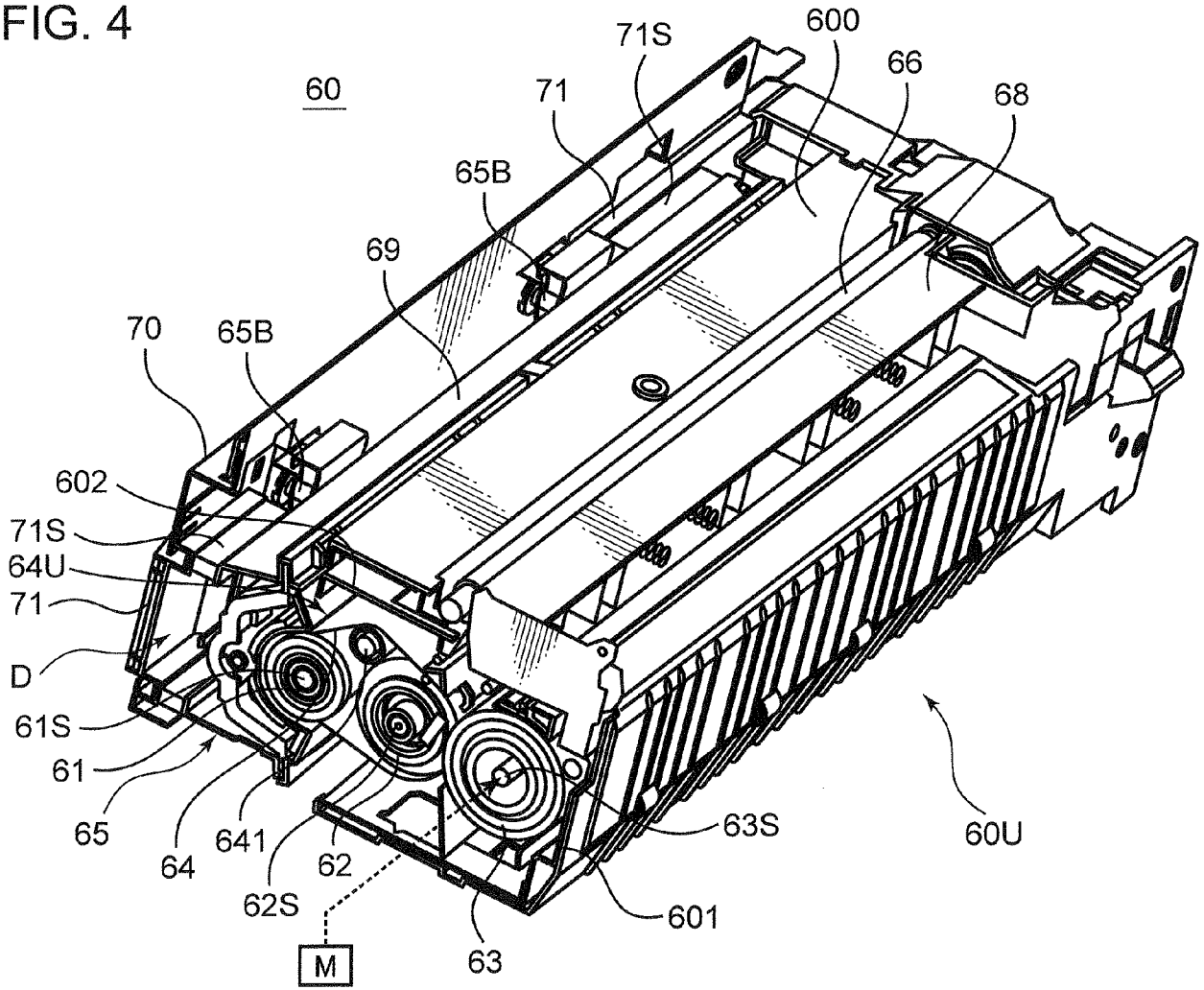
FIG. 4 is a partially cutaway perspective view of the fixing device.
Figure 5:
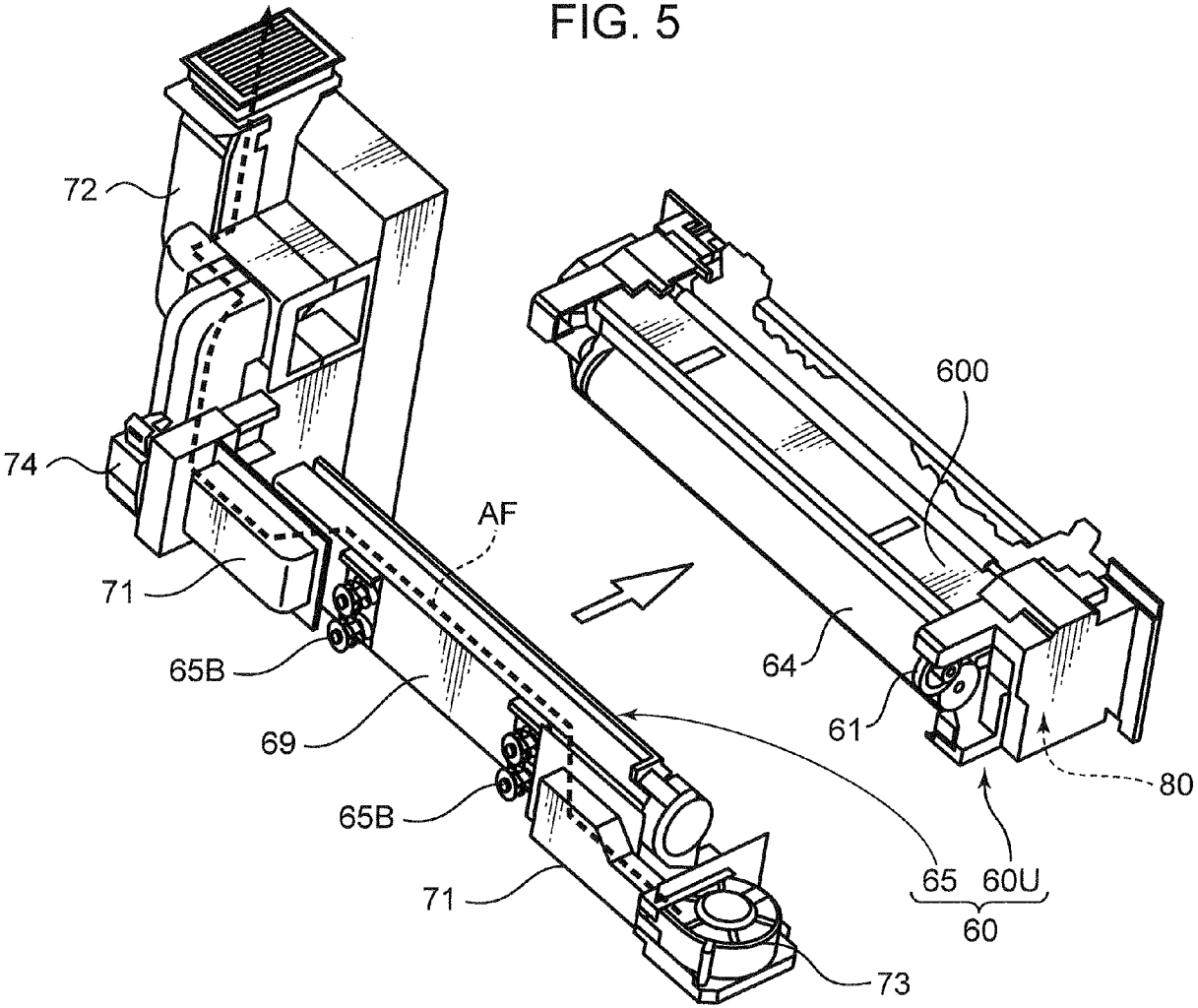
FIG. 5 is an exploded perspective view of the fixing device and peripheral devices thereof.
Figure 6:
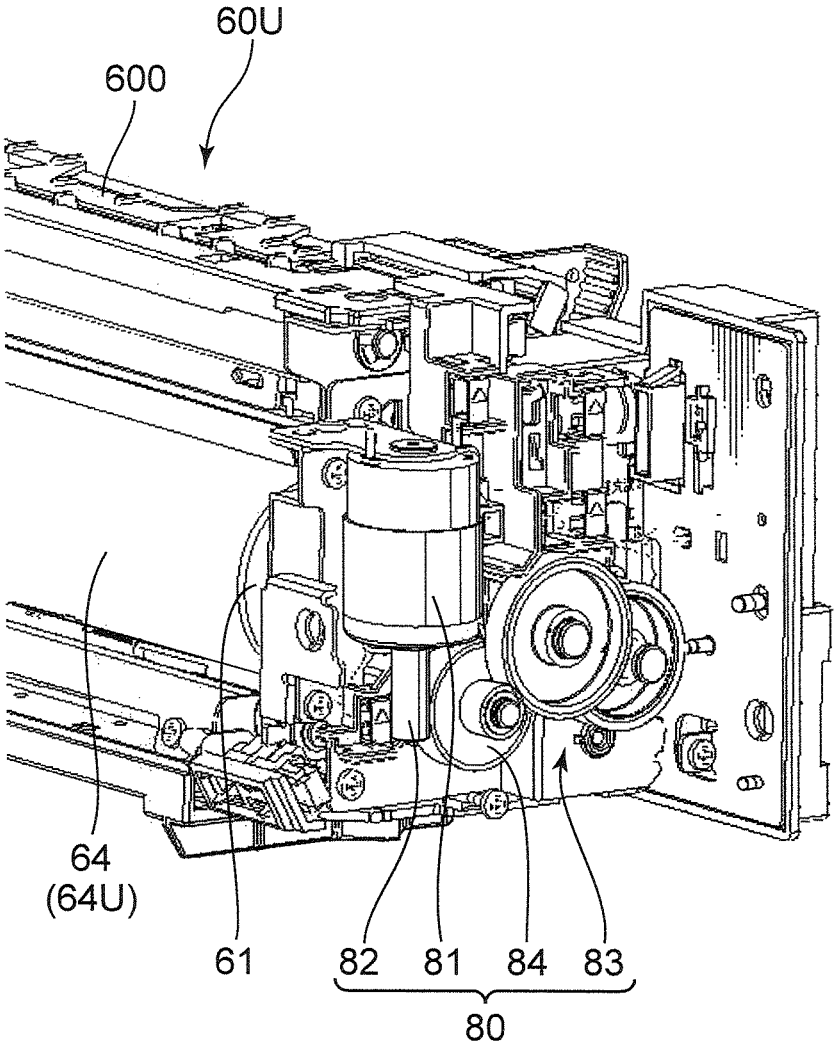
FIG. 6 is a perspective view of an end portion of the fixing device, showing an arrangement of a nipping pressure adjusting mechanism.

FIG. 3 is a cross-sectional view showing an internal structure of the fixing device 60, FIG. 4 is a partially cutaway perspective view of the fixing device 60, FIG. 5 is an exploded perspective view of the fixing device 60 and peripheral devices thereof, and FIG. 6 is a perspective view of an end portion of the fixing device 60, showing an arrangement of a nipping pressure adjusting mechanism 80. In the following, a detailed structure of the fixing device 60 is described referring to FIGS. 3 through 6.

The housing 600 of the fixing unit 60U has a generally rectangular shape in cross section, and accommodates the members for performing a fixing processing. The housing 600 includes a body frame 601 which is fixedly mounted on the housing 600, and a movable frame 602 which is movably mounted on the main frame 601. Although not illustrated, the movable frame 602 is mounted on the body frame 601 to be pivotally movable about a pivot fulcrum formed on the body frame 601. The housing 600 has an opening at a position corresponding to an upper right corner of the housing 600 in FIG. 3, and the opening is covered by an openable and closable cover member 68. In the case where a failure such as a sheet jam has occurred in the fixing unit 60U, the cover member 68 is opened upward.

The heating roller 61 is a roller to be inductively heated by the induction heating unit 65. The heating roller 61 is made of a magnetic metal such as iron or stainless steel, and a releasing layer made of e.g. a PFA resin is formed on the surface of the heating roller 61. The heating roller 61 has a rotary shaft (a third rotary shaft 61S), and is rotated about the axis of the third rotary shaft 61S.

The fixing roller 62 and the pressing roller 63 have the circumferential surfaces thereof being pressed against each other, with the fixing belt 64 being interposed therebetween. The fixing roller 62 and the pressing roller 63 are rollers for forming a fixing nip portion 60N. A sheet to which a toner image has been transferred by secondary transfer in the secondary transfer section 35A is allowed to pass the fixing nip portion 60N, and undergoes heating and pressurization, whereby the toner image is fixed onto the sheet surface.

The fixing roller 62 is an elastic roller having an elastic layer as an outer layer thereof. An example of the elastic layer is an elastic layer made of a silicone sponge. The fixing roller 62 has a rotary shaft (a second rotary shaft 62S), and is rotated about the axis of the second rotary shaft 62S.

The pressing roller 63 is a roller to be pressingly contacted with the fixing roller 62 for forming the fixing nip portion 60N having a certain width. A preferred example of the pressing roller 63 is a roller consisted of a core member made of a metal such as iron or aluminium, a silicone rubber layer formed on the core member, and a fluorine resin layer formed on the surface of the silicone rubber layer. The pressing roller 63 is configured in such a manner that the outer layer thereof has hardness (first hardness) higher than the hardness (second hardness) of the outer layer of the fixing roller 62. The pressing roller 63 is internally provided with a heating element such as a halogen heater. The pressing roller 63 has a rotary shaft (a first rotary shaft 63S), and as will be described later, rotates about the axis of the first rotary shaft 63S.

The fixing belt 64 is a belt which is wound around the heating roller 61 and the fixing roller 62, and is inductively heated by the induction heating unit 65 as well as the heating roller 61. A tension roller 641 for giving a tension force to the fixing belt 64 is brought into contact with the inner circumferential surface of the fixing belt 64. The fixing belt 64 is formed by e.g. placing a silicone rubber elastic layer and a PFA resin releasing layer one over the other on a base member made of a ferromagnetic material such as nickel. In the case where the fixing belt 64 is simply used as a carrier of heat generated by the heating roller 61 without imparting a heated function to the fixing belt 64, it is possible to use a resin belt made of e.g. a PI (polyimide) resin.

The first rotary shaft 63S of the pressing roller 63 is rotatably supported by the body frame 601 in the housing 600. On the other hand, the third rotary shaft 61S of the heating roller 61 and the second rotary shaft 62S of the fixing roller 62 are rotatably supported by the movable frame 602 in the housing 600. In other words, whereas the first rotary shaft 63S of the pressing roller 63 is supported in the housing 600 in a state that the first rotary shaft 63S is substantially immovable, the third rotary shaft 61S of the heating roller 61 and the second rotary shaft 62S of the fixing roller 62 are supported in the housing 600 in a state that a position of the third rotary shaft 61S and a position of the second rotary shaft 62S are movable. As shown in FIG. 9, both end portions 61E of the third rotary shaft 61S, and both end portions 62E of the second rotary shaft 62S project outwardly from the movable frame 602. Oblong holes 601H are formed in the body frame 601, and the end portions 62E of the movable second rotary shaft 62S are received in the oblong holes 601H.

Specifically, the image forming apparatus 1 is configured in such a manner that: the heating roller 61, the fixing roller 62, the tension roller 641 and the fixing belt 64 are loaded on the movable frame 602 and constitute a belt unit 64U; and that the belt unit 64U is moved by the nipping pressure adjusting mechanism 80 shown in FIG. 6 to thereby move the position of the second rotary shaft 62S and the third rotary shaft 61S. As will be described later in detail referring to FIGS. 7 through 9, the nipping pressure adjusting mechanism 80 adjusts the nipping pressure of the fixing nip portion 60N by moving the movable frame 602. Specifically, the nipping pressure adjusting mechanism 80 causes the fixing roller 62 to change the posture of the fixing roller 62 between a normal pressurized posture (a first posture) that the circumferential surface of the fixing roller 62 is pressingly contacted with the circumferential surface of the pressing roller 63 with a relatively large pressure (a first pressure), and a depressurized posture (a second posture) that the circumferential surface of the fixing roller 62 is pressingly contacted with the circumferential surface of the pressing roller 63 with a relatively small pressure (a second pressure).

The nipping pressure adjusting mechanism 80 includes a motor 81 which generates a driving force for moving the movable frame 602, and a drive gear train 83. The motor 81 is loaded on a side wall of the housing 600, and an output gear 82 of the motor 81 meshes with a first gear 84 of the drive gear train 83. The drive gear train 83 includes a plurality of speed reducing gears, and a sector gear which is not shown in FIG. 6. The drive gear train 83 transmits the driving force generated in the motor 81 to the movable frame 602 for moving a position of the movable frame 602 between the normal pressurized posture and the depressurized posture.

As schematically shown in FIG. 4, a rotational driving force is inputted from a motor M (a driving mechanism) disposed on the apparatus body 10 side to the first rotary shaft 63S of the pressing roller 63 via a predetermined speed reducing mechanism. As the pressing roller 63 rotates, the heating roller 61, the fixing roller 62, the tension roller 641 and the fixing belt 64 are rotated. As described above, the pressing roller 63 has higher hardness than the hardness of the fixing roller 62. Accordingly, the first rotary shaft 63S of the pressing roller 63 is suitable for inputting a driving force from the motor M in the aspect that the circumferential speed of the outer circumference of the pressing roller 63 is less likely to vary when the pressing roller 63 is driven to rotate.

The induction heating unit 65 is a unit for generating magnetic flux for generating heat necessary for a fixing processing. The induction heating unit 65 is provided with an induction heating coil 651, core members constituted of a center core 652, a plurality of pairs of arch cores 653 and a pair of side cores 654, and a unit housing 650 (a holding member) which accommodates these members therein.

The induction heating coil 651 is adapted to generate magnetic flux for inductively heating the heating roller 61 and the fixing belt 64, and is disposed on an imaginary arc plane when viewed in cross section. The imaginary arc plane opposes the arc plane of the heating roller 61 and the fixing belt 64 when viewed in cross section. The center core 652, the plurality of pairs of arch cores 653 and the pair of side cores 654 are each a core member made of ferrite, and are disposed to form a magnetic path passing a part of the heating roller 61 and the fixing belt 64. With this arrangement, when magnetic flux generated in the induction heating coil 651 passes the magnetic path, an eddy current is generated in the heating roller 61 and the fixing belt 64, and Joule heat by generation of an eddy current is generated.

The unit housing 650 is a housing member which holds the induction heating coil 651 and the core members, and is formed with an arc-shaped recess 65H in which a part of the heating roller 61 and the fixing belt 64 is received. The unit housing 650 of the induction heating unit 65, and a side surface (a left side surface in FIG. 3) of the housing 600 of the fixing unit 60U are engaged with each other in a positioned state, and a gap of a predetermined interval is formed between the inner surface of the recess 65H and the outer surface of the fixing belt 64.

The aforementioned gap (in other words, a relative positional relationship between the heating roller 61 and the fixing roller 62, and the induction heating unit 65) is retained by a retaining mechanism whenever the belt unit 64U is brought to the normal pressurized posture or the depressurized posture in response to moving the belt unit 64U by the nipping pressure adjusting mechanism 80. In this embodiment, the housing unit 600 of the fixing unit 60U has positioning pin 600A and a receiving portion 602E, as the retaining mechanism. Further, the unit housing 650 of the induction heating unit 65 is formed with an insertion hole 65A corresponding to the positioning pin 600A, an abutting portion 650E corresponding to the receiving portion 602E, and receiving grooves 650C (positioning recesses, see FIGS. 9A and 9B) for receiving the end portions 61E of the third rotary shaft 61S. The insertion hole 65A, the abutting portion 650E, and the receiving grooves 650C constitute an engagement structure portion. With this arrangement, the induction heating unit 65 is positioned utilizing both end portions (the end portions 61E) of the third rotary shaft 61S. In other words, since the third rotary shaft 61S itself serves as a positioning member, the induction heating coil 651 and the heating roller 61 can be precisely positioned to each other.

The retaining mechanism further includes coil springs 65B (an urging mechanism). The coil springs 65B each is a compression spring, and is disposed at such a position as to urge the unit housing 650 toward the housing 600 for retaining the gap. Specifically, the abutting portion 650E is abutted against the receiving portion 602E by the urging force of the coil springs 65B, and the end portions 61E of the third rotary shaft 61S are respectively abutted against end surfaces of the receiving grooves 650C opposite to the surface of the receiving grooves 650C where the coil springs 65B are disposed. It should be noted that when the fixing unit 60U is dismounted from the apparatus body 10, the positioning pin 600A is disengaged from the insertion hole 65A, and the abutting portion 650E is moved away from the receiving portion 602E, whereby the engagement between the end portions 61E and the receiving grooves 610C is released.

Referring to FIG. 3, the conveyance roller pair 66 is a conveyance roller pair for feeding a sheet that has passed the fixing nip portion 60N to the horizontal conveyance path 50D downstream of the housing 600. The conveyance roller pair 66 is constituted of a first conveyance roller 661 which is rotatably supported on the housing 600, and a second conveyance roller 662 which is rotatably supported on the cover member 68. The first conveyance roller 661 is a drive roller to which a rotational driving force is inputted from the apparatus body 10 side, and the second conveyance roller 662 is a driven roller that is rotated as the first conveyance roller 661 rotates. The second conveyance roller 662 is pressingly contacted with the first conveyance roller 661 with a predetermined nipping pressure for generating a sheet conveying force.

A pair of guide members 671, 672 are disposed upstream of the fixing nip portion 60N in the sheet conveyance direction for guiding a sheet to be fed toward the fixing nip portion 60N. Further, a pair of guide members 673, 674 are disposed downstream of the fixing nip portion 60N in the sheet conveyance direction for guiding a sheet to be discharged from the fixing nip portion 60N toward the conveyance roller pair 66. Furthermore, a swingable actuator 67A is disposed downstream of the fixing nip portion 60N in the sheet conveyance direction for detecting that a sheet has passed.

Referring to FIG. 3, the fixing roller 62 and the fixing belt 64 rotate counterclockwise, and the pressing roller 63 rotates clockwise. A separation plate 675 is disposed as opposed to the circumferential surface of the fixing belt 64, downstream of the fixing nip portion 60N in the rotating direction of the fixing roller 62 and the fixing belt 64, and a separation pawl 676 is disposed as opposed to the circumferential surface of the pressing roller 63. The separation plate 675 and the separation pawl 676 are disposed to separate a sheet which is about to be wound around the circumferential surface of the fixing belt 64 or the pressing roller 63 therefrom. The separation plate 675 is a plate-like member extending in the axis direction of the fixing roller 62, and a very small clearance is defined between the tip end of the separation plate 675 and the circumferential surface of the fixing belt 64. On the other hand, the separation pawl 676 is a member having a width thereof in the axis direction of the pressing roller 63 in the range of about several millimeters. The tip end of the separation pawl 676 is abutted against the circumferential surface of the pressing roller 63. Whereas the separation plate 675 is a single plate member having a length substantially equal to the width of a paper passing area, a plurality of separation pawls 676 are disposed at a certain interval in the axis direction of the pressing roller 63.

Referring to FIGS. 3 through 5, a duct member 69 is integrally mounted on the back surface of the unit housing 650. A body frame 70 of the apparatus body 10 is disposed on the back surface of the duct member 69. In FIG. 5, the body frame 70 is not shown. The coil springs 65B are disposed between the body frame 70 and the back surface of the duct member 69.

The coil springs 65B are provided at two positions away from each other in the axis direction of the heating roller 61 in a state that a pair of coil springs 65B is disposed at each of the two positions. Each of the coil springs 65B is received in a shaft 65S. The shaft 65S is a member protruding from a pressing plate 691 (a second abutting portion), which is in pressing contact with the back surface of the duct member 69, in a direction orthogonal to the axis direction of the heating roller 61, and a tip end of the shaft 65S passes through a hole (not shown) formed in the body frame 70. An end of each coil spring 65B is abutted against a sprig washer 701 (a first abutting portion) in pressing contact with the body frame 70, and the other end of each coil spring 65B is abutted against the pressing plate 691.

A space D (an air passage) through which cooling air is allowed to pass is formed in the duct member 69. As shown in FIG. 5, connecting portions (not shown) to be connected to main body cooling ducts 71, 71 which are provided on the apparatus body 10 side are disposed on the back surface of the duct member 69 at a position near both ends of the duct member 69. The duct member 69 is opened at the connecting portions, and the space D and the interior of the main body cooling ducts 71, 71 are communicated to each other.

An exhaust duct 72 is connected to the main body cooling duct 71 downstream of a cooling air passage. A cooling fan 73 for drawing in cooling air is disposed in the main body cooling duct 71 upstream of the cooling air passage, and a cooling fan 74 for drawing out cooling air is disposed between the exhaust duct 72 and the main body cooling duct 71 downstream of the cooling air passage. By driving the cooling fans 73, 74, an air passage AF of cooling air from the main body cooling duct 71 upstream of the cooling air passage, the duct member 69, the main body cooling duct 71 downstream of the cooling air passage to the exhaust duct 72 is formed to thereby cool the induction heating unit 65.

As shown in FIG. 4, elastic seal members 71S are interposed in each of the connecting portions between the main body cooling ducts 71 and the duct member 69. Whereas the body frame 70 is kept unmoved, the duct member 69 integrally formed with the induction heating unit 65 is moved by being pressed by the coil springs 65B. The elastic seal members 71S are disposed at such a position as to prevent leakage of cooling air from the connecting portions between the main body cooling ducts 71 and the duct member 69, regardless of such a movement.

Figure 7A:
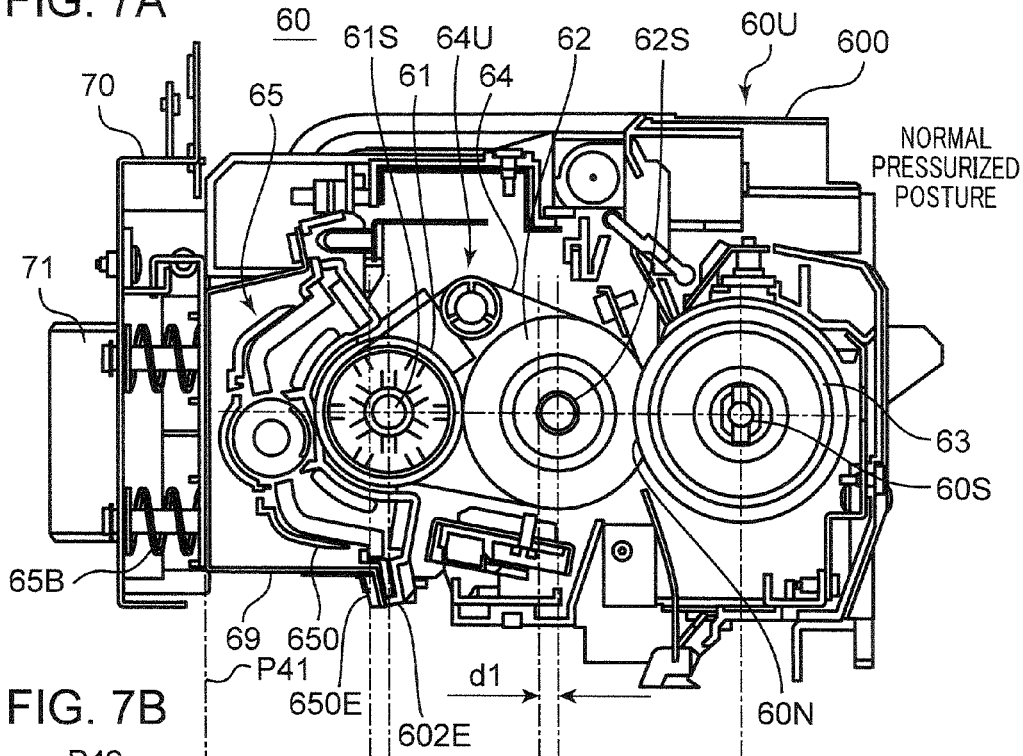
FIGS. 7A and 7B are cross-sectional views of the fixing device, specifically, diagrams for describing how rotary shafts of a fixing roller and a heating roller are moved.
Figure 7B:
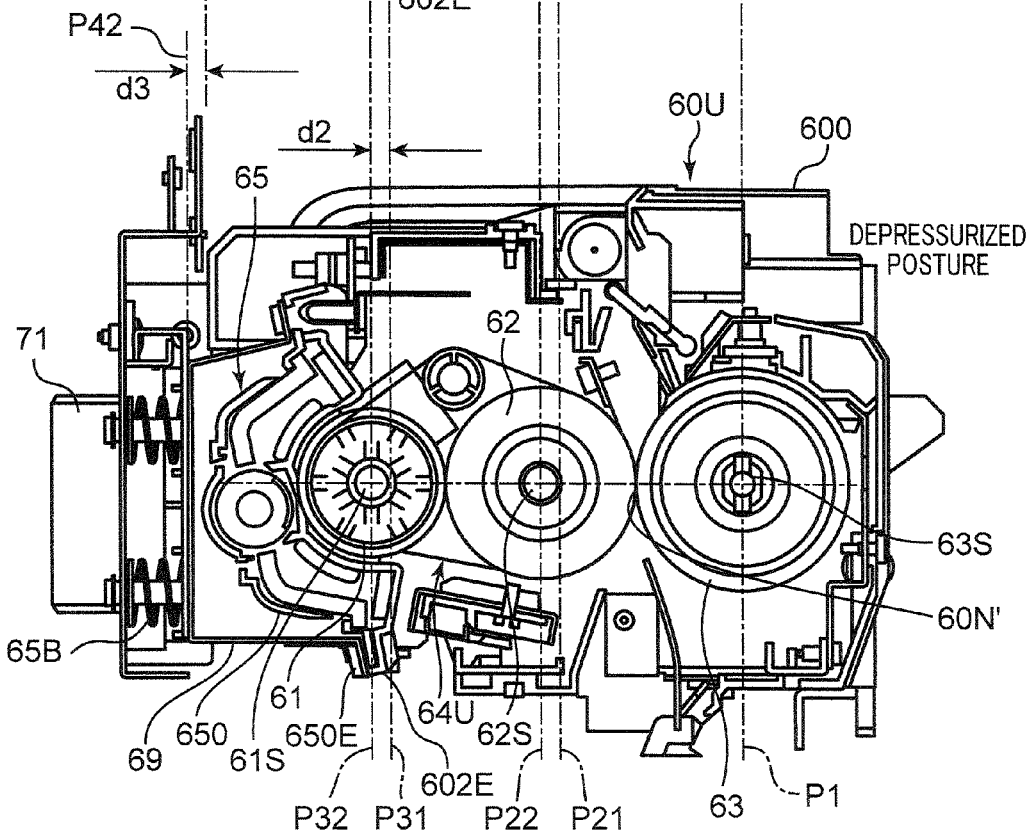
Figure 8:
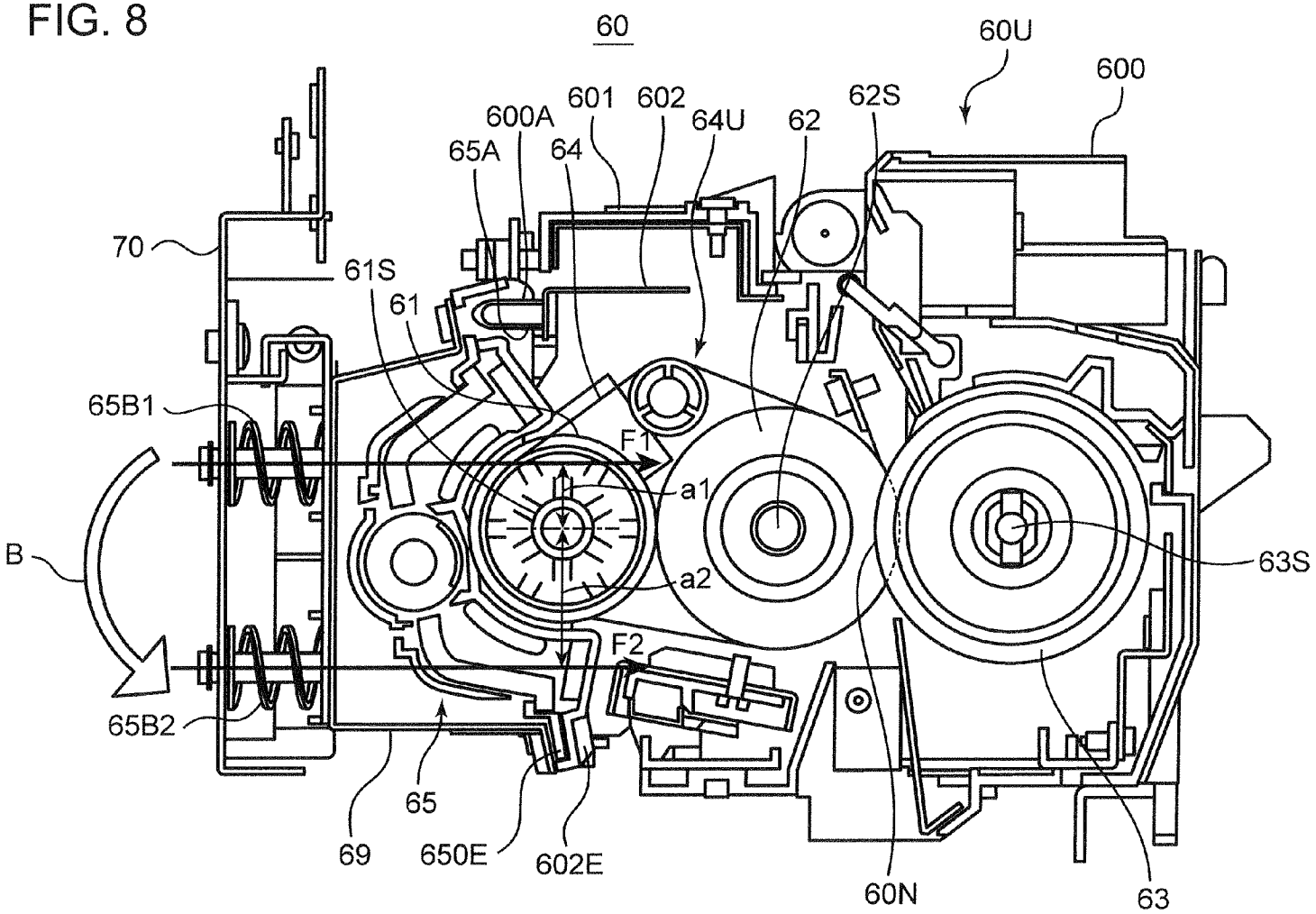
FIG. 8 is a cross-sectional view of the fixing device, specifically, a diagram for describing an arrangement of a retaining mechanism.

In the following, a moving operation of the belt unit 64U by the nipping pressure adjusting mechanism 80 is described referring to FIGS. 7A, 7B. FIG. 7A shows a state that the fixing roller 62 (the belt unit 64U) is set in the normal pressurized posture in the fixing nip portion 60N, and FIG. 7B shows a state that the fixing roller 62 is set in the depressurized posture in the fixing nip portion 60N. The normal pressurized posture is a state that a high nipping pressure is applied in the fixing nip portion 60N, and is set in the case where a sheet of ordinary thickness is allowed to pass the fixing nip portion 60N. The depressurized posture is a state that a low nipping pressure is applied in the fixing nip portion 60N, and is set in the case where thick paper such as an envelope or thin paper is allowed to pass the fixing nip portion 60N, or a jammed sheet is removed from the fixing unit 60U.

As described above, the first rotary shaft 63S of the pressing roller 63 is supported by the body frame 601 which is fixedly mounted in the housing 600. Accordingly, the first rotary shaft 63S is kept unmoved both in the case where the fixing roller 62 is set in a normal pressurized posture and in a depressurized posture. In other words, the position of the first rotary shaft 63S is kept unchanged. In this embodiment, a rotational driving force is inputted from the motor M (see FIG. 4) provided in the apparatus body 10 to the first rotary shaft 63S which is kept unmoved. Accordingly, the input mechanism of a rotational driving force can be simplified.

On the other hand, the belt unit 64U is supported by the movable frame 602 in the housing 600. When the nipping pressure adjusting mechanism 80 moves the movable frame 602 to change the posture of the fixing roller 62 from the normal pressurized posture to the depressurized posture, the position of the second rotary shaft 62S of the fixing roller 62 and a position of the third rotary shaft 61S of the heating roller 61 are moved. More specifically, the position of the second rotary shaft 62S is moved from a position P21 to a position P22 by a distance d1, and the position of the third rotary shaft 61S is moved from a position P31 to a position P32 by a distance d2, where d1=d2.

In this embodiment, since the aforementioned retaining mechanism is provided, the induction heating unit 65 is also moved, as the belt unit 64U is moved. In the case where the posture of the fixing roller 62 is shifted from the depressurized posture shown in FIG. 7B to the normal pressurized posture shown in FIG. 7A, a position of the belt unit 64U is moved in a direction toward the pressing roller 63. When the position of the belt unit 64U is moved in this way, the state that the unit housing 650 of the induction heating unit 65 is pressingly contacted with the housing 600 of the fixing unit 60U is retained by the urging force of the coil springs 65B. Specifically, there is retained a state that the abutting portion 650E of the unit housing 650 is abutted against the receiving portion 602E by the urging force, and the end portions 61E of the third rotary shaft 61S are pressed against the receiving grooves 650C (see FIG. 9). Further, there is retained a state that the positioning pin 600A is received in the insertion hole 65A.

On the other hand, in the case where the posture of the fixing roller 62 is shifted from the normal pressurized posture shown in FIG. 7A to the depressurized posture shown in FIG. 7B, the belt unit 64U is moved in a direction away from the pressing roller 63. When the belt unit 64U is moved in this way, the induction heating unit 65 receives a pressing force against the urging force of the coil springs 65B from the belt unit 64U. With this arrangement, the induction heating unit 65 is moved leftward in FIG. 7B, and the coil springs 65B are brought to a compressed state. In other words, the position (in this example, corresponding to the position of the duct member 69) of the induction heating unit 65 is shifted from a position P41 corresponding to a state that the fixing roller 62 is in the normal pressurized posture to a position P42 by a distance d3. It should be noted that d3=d2=d1. Accordingly, the relative positional relationship between the belt unit 64U and the induction heating unit 65 is kept unchanged regardless of a posture shifting operation by the nipping pressure adjusting mechanism 80.

In this embodiment, there is provided an improved arrangement of securing firm contact between the induction heating unit 65 and the belt unit 64U. The above point is described referring to FIG. 8 and FIG. 9. The coil springs 65B are provided in a pair (an upper coil spring 65B1 and a lower coil spring 65B2) and vertically disposed away from each other. The third rotary shaft 61S of the heating roller 61 is disposed at such a position as to be displaced upwardly from a midpoint between the upper coil spring 65B1 and the lower coil spring 65B2 (a1<a2).

Figure 9B:
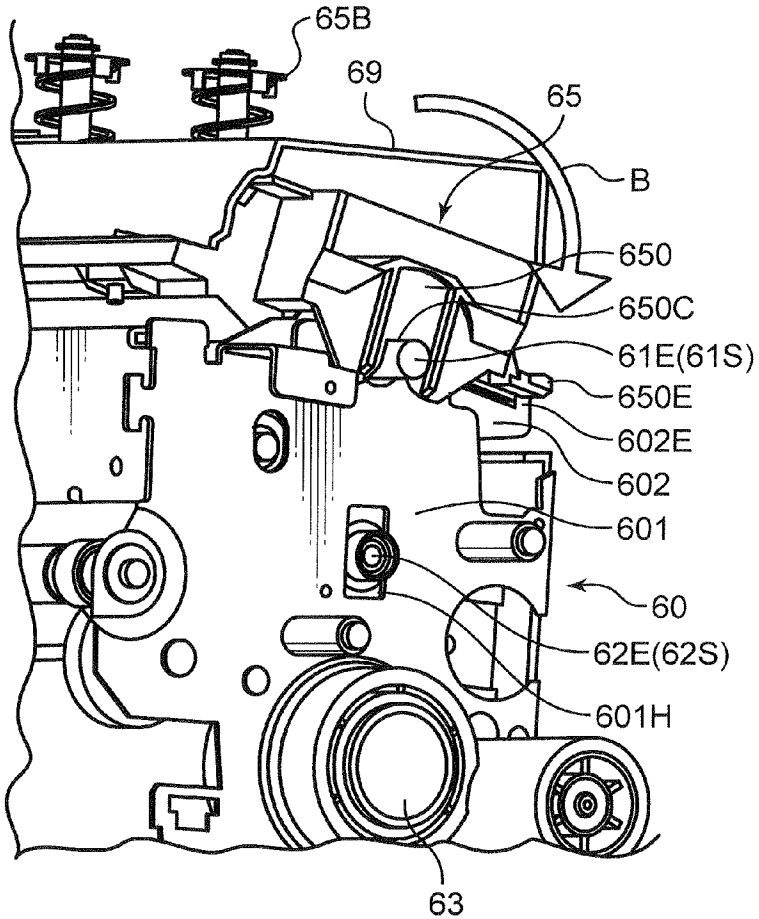
FIG. 9B is a side view of the fixing device when viewed from a direction opposite to the direction in FIG. 9A, each of which describing the arrangement of the retaining mechanism.
Figure 9A:
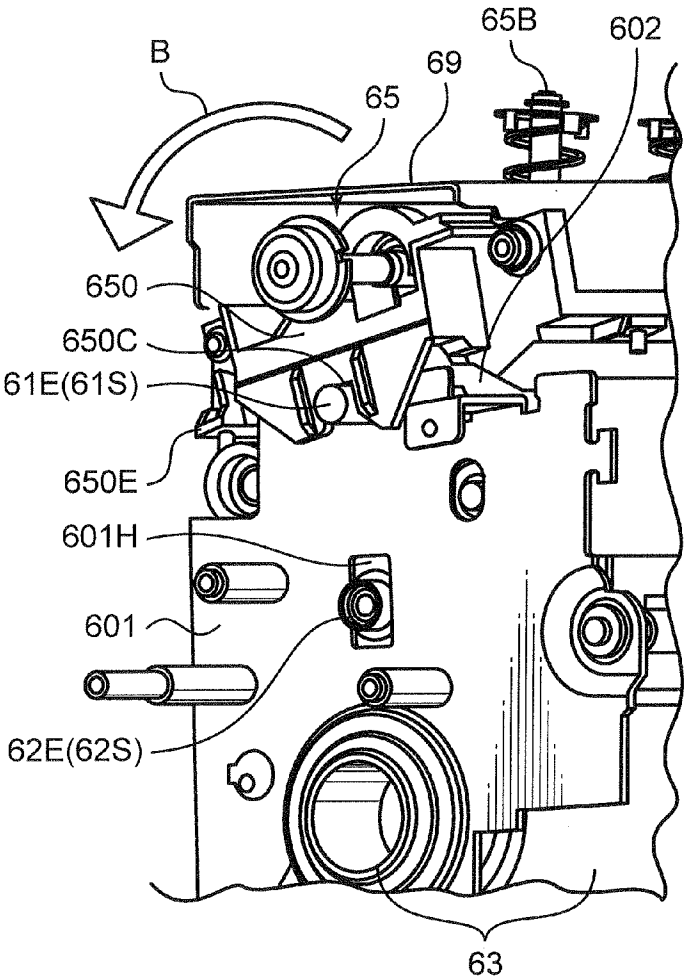
FIG. 9A is a side view of the fixing device when viewed from one direction.

As shown in FIGS. 9A, 9B, the end portions 61E of the third rotary shaft 61S are engaged in the U-shaped receiving grooves 650C. With this arrangement, the unit housing 650 of the induction heating unit 65 is swingable about the axes of the end portions 61E. A pressing force F1 of the upper coil spring 65B1 and a pressing force F2 (F1=F2) of the lower coil spring 65B2 are applied to each of the points of application of force where there is a distance difference of a1:a2. Accordingly, a rotational moment in the direction shown by the arrow B in FIGS. 9A, 9B is exerted on the unit housing 650, and the unit housing 650 swings in the direction of the arrow B about the axes of the end portions 61E in the range of engagement play between the positioning pin 600A and the insertion hole 65A. With this operation, the abutting portion 650E is naturally abutted against the receiving portion 602E, and the induction heating unit 65 and the belt unit 64U can be precisely positioned relative to each other.

In the image forming apparatus 1 of the IH fixing system in the foregoing embodiment, the relative positions between the induction heating unit 65 and the belt unit 64U (the fixing roller 62) are retained by the retaining mechanism including the coil springs 65B, no matter how the posture of the fixing roller 62 is changed by the nipping pressure adjusting mechanism 80. On the other hand, the pressing roller 63 having a hardness higher than the hardness of the fixing roller 62 is supported by the housing 600 (the body frame 601) in an immovable state, and a rotational driving force is applied from the motor M to the pressing roller 63. Accordingly, the embodiment is advantageous in simplifying the input mechanism of a rotational driving force, while retaining the distance relationship between the induction heating unit 65 and the belt unit 64U.

In the foregoing, a preferred embodiment of the present disclosure has been described. The present disclosure is not limited to the above arrangement, but may be modified as follows.

For instance, in the embodiment, the fixing unit 60U is provided with the heating roller 61 and the fixing belt 64. Alternatively, a fixing unit devoid of these elements may be used. An example of the fixing unit devoid of these elements is configured in such a manner that a tubular belt constituted of a magnetic member substantially equivalent to the fixing belt 64 is wound around the outer circumference of the fixing roller 62. In the modification, the induction heating unit 65 inductively heats the tubular belt.

In the present disclosure, an image forming apparatus of an IH fixing system provided with an IH fixing unit having a housing structure to be detachably mounted on the apparatus body enables to simplify a mechanism for inputting a rotational driving force to the fixing unit. Thus, it is possible to simplify the structure of the image forming apparatus, miniaturize the image forming apparatus of an IH fixing system, and realize cost reduction.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus equipped with an induction heating fixing system, comprising:

a first housing which accommodates a member for performing a fixing processing;

a second housing which accommodates an image forming section for forming an image onto a sheet, the second housing being mounted with the first housing thereon;

a first roller having a first rotary shaft, and rotatably supported by the first housing in a state that the first rotary shaft is positionally immovable;

a second roller having a second rotary shaft, rotatably supported by the first housing in a state that the second rotary shaft is positionally movable, and forming, with the first roller, a fixing nip portion in which the fixing processing is applied to the sheet;

a nipping pressure adjusting mechanism which changes a posture of the second roller between a first posture that the second roller is pressingly contacted with the first roller with a first pressure, and a second posture that the second roller is pressingly contacted with the first roller with a second pressure lower than the first pressure, the second pressure being set lower than the first pressure by moving a position of the second rotary shaft from the first posture;

an induction heating unit mounted on the second housing for generating heat necessary for the fixing processing;

a retaining mechanism which retains relative positions between the second roller and the induction heating unit both in the case where the second roller is in the first posture and in the second posture; and a driving mechanism which gives a rotational driving force to the first roller.

2. The image forming apparatus according to claim 1, wherein the first roller is made of a material having a first hardness, and the second roller is made of a material having a second hardness lower than the first hardness.

3. The image forming apparatus according to claim 1, wherein the first housing includes a body frame, and a movable frame mounted on the body frame to be movable relative to the body frame, the first roller is supported by the body frame, the second roller is supported by the movable frame, and the retaining mechanism includes an engagement structure portion which positions the induction heating unit relative to the movable frame for engagement between the induction heating unit and the movable frame, and an urging mechanism which gives the induction heating unit an urging force for retaining the engagement.

4. An image forming apparatus comprising:

a first housing that accommodates a member for performing a fixing processing, the first housing includes a body frame, and a movable frame mounted on the body frame to be movable relative to the body frame;

a second housing that accommodates an image forming section for forming an image onto a sheet, the second housing being mounted with the first housing thereon;

an induction heating unit mounted on the second housing for generating heat necessary for fixing processing;

a first roller having a first rotary shaft, and rotatably supported by the body frame of the first housing in a state that the first rotary shaft is positionally immovable;

a second roller having a second rotary shaft, rotatably supported by the movable frame of the first housing in a state that the second rotary shaft is positionally movable, and forming, with the first roller, a fixing nip portion in which the fixing processing is applied to the sheet;

a third roller including a third rotary shaft, the third roller being supported by the movable frame with the induction heating unit opposing the third roller when the first housing is mounted on the second housing so that the third roller is inductively heated by the induction heating unit;

a belt wound around the second roller and the third roller;

a nipping pressure adjusting mechanism that changes a posture of the second roller between a first posture where the second roller pressingly contacts the first roller with a first pressure, and a second posture where the second roller pressingly contacts the first roller with a second pressure lower than the first pressure, the second pressure being set lower than the first pressure by moving a position of the second rotary shaft from the first posture;

a retaining mechanism that retains relative positions between the second roller and the induction heating unit both when the second roller is in the first posture and in the second posture; and a driving mechanism that gives a rotational driving force to the first roller, wherein the retaining mechanism includes an engagement structure that positions the induction heating unit relative to the movable frame for engagement between the induction heating unit and the movable frame, and an urging mechanism that gives the induction heating unit an urging force for retaining the engagement.

5. The image forming apparatus according to claim 4, wherein the induction heating unit includes an induction heating coil for generating magnetic flux, a core member for forming a magnetic path, and a holding member for holding the induction heating coil and the core member, the movable frame rotatably supports the third rotary shaft of the third roller, with both end portions of the third rotary shaft projecting from the movable frame, and the engagement structure portion is constituted of both end portions of the third rotary shaft, and positioning recesses formed in the holding member for respectively receiving the both end portions of the third rotary shaft.

6. The image forming apparatus according to claim 3, wherein the urging mechanism includes a compression spring;

a first abutting portion to be abutted against one end of the compression spring on a side of the second housing; and a second abutting portion to be abutted against an other end of the compression spring on a side of the induction heating unit, and the induction heating unit is moved as the movable frame is moved.

7. The image forming apparatus according to claim 6, further comprising:

a duct member mounted on the induction heating unit for forming an air passage for cooling the induction heating unit;

a cooling duct provided in the second housing and connected to the duct member; and an elastic seal member disposed at a connecting portion between the cooling duct and the air passage.

* * * * *